US007992806B2

(12) United States Patent
Qiu

(10) Patent No.: US 7,992,806 B2
(45) Date of Patent: Aug. 9, 2011

(54) SHOWERHEAD WITH ROTATIONALLY ADJUSTABLE HANDLE

(75) Inventor: Jiasen Qiu, Guangdong Province (CN)

(73) Assignee: Globe Union Industrial Corp., Taichung County (TW)

( * ) Notice: Subject to any disclaimer, the term of this patent is extended or adjusted under 35 U.S.C. 154(b) by 320 days.

(21) Appl. No.: 12/270,971

(22) Filed: Nov. 14, 2008

(65) Prior Publication Data

US 2010/0122409 A1 May 20, 2010

(51) Int. Cl.
*A62C 31/00* (2006.01)

(52) U.S. Cl. ..... 239/444; 239/447; 239/442; 239/551; 239/562; 239/581.1

(58) Field of Classification Search ..... 239/442, 239/444, 447, 551, 581.1, 562
See application file for complete search history.

(56) References Cited

U.S. PATENT DOCUMENTS

| | | | | |
|---|---|---|---|---|
| 6,126,290 | A * | 10/2000 | Veigel | 362/96 |
| 6,981,661 | B1 * | 1/2006 | Chen | 239/532 |
| 7,156,325 | B1 * | 1/2007 | Chen | 239/394 |
| 2008/0156902 | A1 * | 7/2008 | Luettgen et al. | 239/447 |

* cited by examiner

*Primary Examiner* — Dinh Q Nguyen
(74) *Attorney, Agent, or Firm* — Tim Tingkang Xia; Morris, Manning & Martin, LLP

(57) ABSTRACT

A showerhead with a rotationally adjustable handle includes a handle unit, a water outlet head unit, and a water inlet control unit. The handle unit has a hollow structure therein and has a first, a second, and a third communicating pipe penetrating therethrough. The water outlet head unit has a cover cap and an outlet valve assembly. The cover cap is connected to a first end of the handle unit and provided with an accommodating space for accommodating the outlet valve assembly. The outlet valve assembly is connected to one ends of the first, the second, and the third communicating pipe. The water inlet control unit is connected to a second end of the handle unit and is rotated to control a water inlet state among a plurality of stages, such that a water flow is guided into any one or a combination of any two of the communicating pipes.

7 Claims, 5 Drawing Sheets

SHOWERHEAD WITH ROTATIONALLY ADJUSTABLE HANDLE

BACKGROUND OF THE INVENTION

1. Field of the Invention

The present invention relates to a showerhead structure, and more particularly to a hand-held showerhead, in which a water inlet control function is configured at a tail end of a handle, so that a water outlet head becomes thinner in volume, thereby reducing the weight of the water outlet head.

2. Related Art

Currently, a hand-held showerhead, especially the hand-held showerhead structure with a multi-stage or multi-mode adjustment function for adjusting water-spraying modes, substantially includes a handle portion, a water-outlet base, and a rotary member. The handle portion is mainly provided for a user to hold and guides a water flow from a water inlet end to a water outlet end. The water-outlet base is mounted and fixed at the water outlet end of the handle portion and is communicated with the water outlet end, so as to utilize the twists and turns of flow channels therein to guide the water flow to move downward. The rotary member is movably fastened on the water-outlet base for the user to rotationally adjust to a desired water-spraying mode. The rotary member further includes an outlet valve, an operation frame, and a face cover portion. The outlet valve is formed by an upper cover, a middle cover, and a lower cover connected to one another. A plurality of chambers is defined between the upper cover, the middle cover, and the lower cover. A plurality of holes is provided at predetermined positions of the upper cover, the middle cover, and the lower cover. When the user turns to adjust the rotary member to make the predetermined holes of the upper cover be aligned with the water flow of the water-outlet base, the water flow from the water-outlet base is guided to the holes corresponding to the lower cover through the corresponding chambers therebetween, so as to achieve a predetermined water-spraying effect.

Since the rotary member is installed on the water-outlet base, one end of the entire hand-held showerhead is heavier than the other end, so that the user has an unbalanced feeling when holding the hand-held showerhead. Moreover, the water-outlet base has a large area, such that a force applied by the user has a large moment when the rotary member is rotationally adjusted, which causes greater effort and brings inconveniences. Besides, with the rotary member additionally disposed at the water-outlet base, the structure at the portion of the water-outlet base is rather complex, and the variations and flexibilities in the appearance design are reduced.

Therefore, the above hand-held showerhead structure in the prior art may have the following problems.

1. The rotary member (water outlet switch) is disposed at the water-outlet base (head of the showerhead), such that the water-outlet base has more structural elements and becomes complex, and the thickness thereof must be increased.
2. Since the water-outlet base (head of the showerhead) has more structural elements, the weight of the entire water-outlet base is increased, so that the user has a top-heavy and unbalanced feeling when holding the showerhead with a hand.
3. The water-outlet base (head of the showerhead) has a large area, such that a large moment of force is required when switching the water outlet (turning the rotary member), thereby bringing inconveniences to the operation.

4. The water-outlet base (head of the showerhead) has a complex structure and increased elements, such that the available space is reduced, and the flexibilities and variations in the appearance design of the water-outlet base are reduced accordingly, and thus the configurations thereof cannot be easily varied.

SUMMARY OF THE INVENTION

Accordingly, the present invention is directed to a hand-held showerhead structure, in which a rotationally adjusting structure is disposed at a tail end of a handle to reduce a moment of the applied force, thereby facilitating the operation. In the prior art, the adjusting structure is disposed at an expanded head of the showerhead and thus it is inconvenient for kids or children having small palms to apply a force. However, the showerhead is convenient for children to hold when the adjusting structure is disposed at the handle.

The present invention is also directed to a hand-held showerhead structure, which is suitable for enabling an overall head structure of the showerhead to become thinner and lighter, so as to avoid an unbalanced situation when being held by a user.

The present invention is further directed to a hand-held showerhead structure, which enables a head structure of the showerhead to be designed into various configurations.

In order to achieve the above objectives, a showerhead with a rotationally adjustable handle is provided in the present invention, which includes a handle unit, a water outlet head unit, and a water inlet control unit.

The handle unit is provided with a hollow structure therein and has a first communicating pipe, a second communicating pipe, and a third communicating pipe penetrating therethrough.

The water outlet head unit has a cover cap and an outlet valve assembly. The cover cap is connected to a first end of the handle unit and provided with an accommodating space for accommodating the outlet valve assembly. The outlet valve assembly is connected to one ends of the first communicating pipe, the second communicating pipe, and the third communicating pipe.

The water inlet control unit is connected to a second end of the handle unit and is rotated to control a water inlet state, so as to guide a water flow into any one or a combination of any two of the first communicating pipe, the second communicating pipe, and the third communicating pipe to flow towards the outlet valve assembly.

Through the showerhead with the rotationally adjustable handle of the present invention, the head structure of the showerhead becomes thinner and lighter, and thus it is easily designed into various configurations. Moreover, the user adjusts the water inlet control unit with a smaller force moment than that of the water outlet head unit when adjusting a water outlet state, which is more convenient and saves labor.

BRIEF DESCRIPTION OF THE DRAWINGS

The present invention will become more fully understood from the detailed description given herein below for illustration only, and thus is not limitative of the present invention, and wherein.

DETAILED DESCRIPTION OF THE INVENTION

Figure 1:
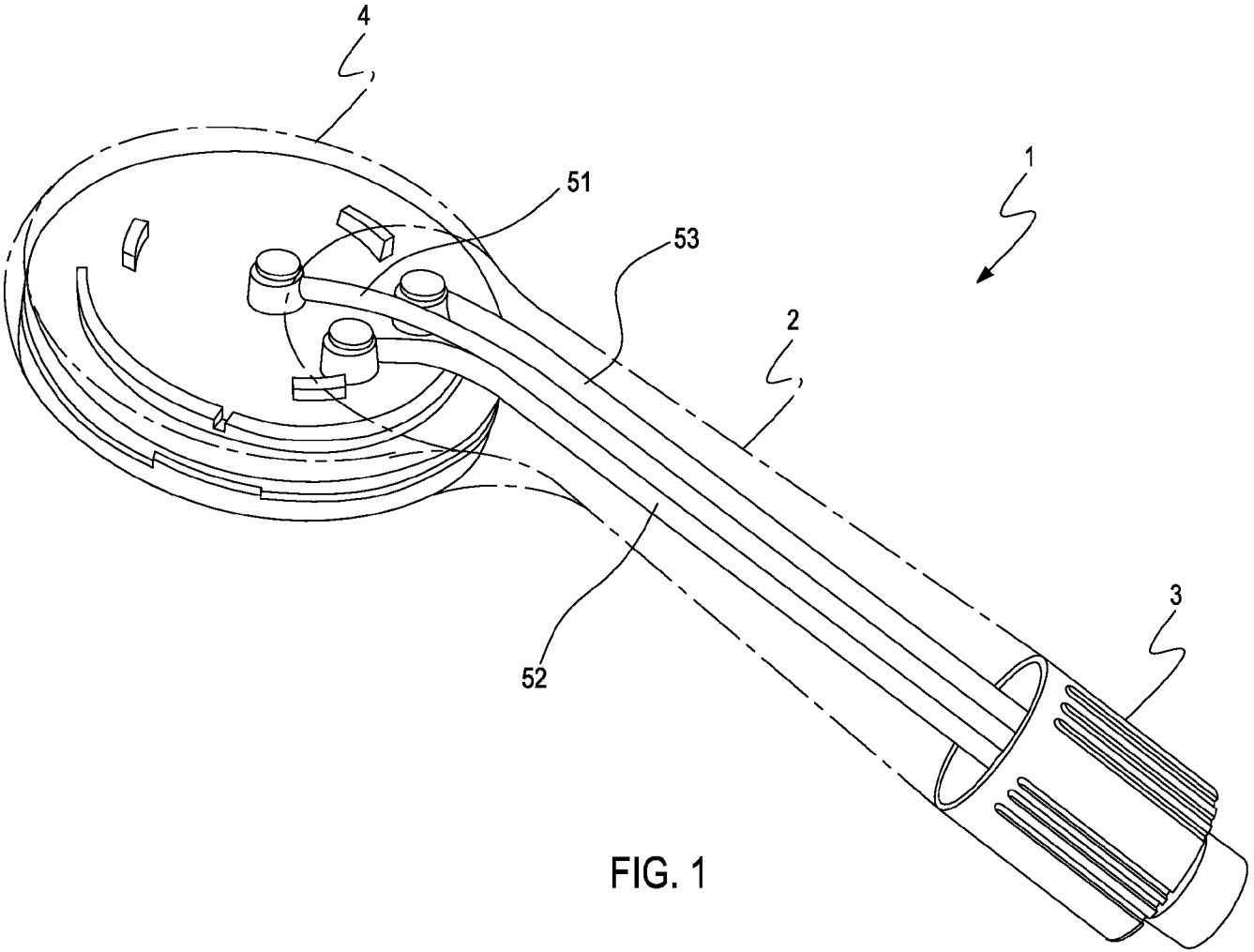
FIG. 1 is a schematic view of a structure according to a preferred embodiment of the present invention.
Figure 2:
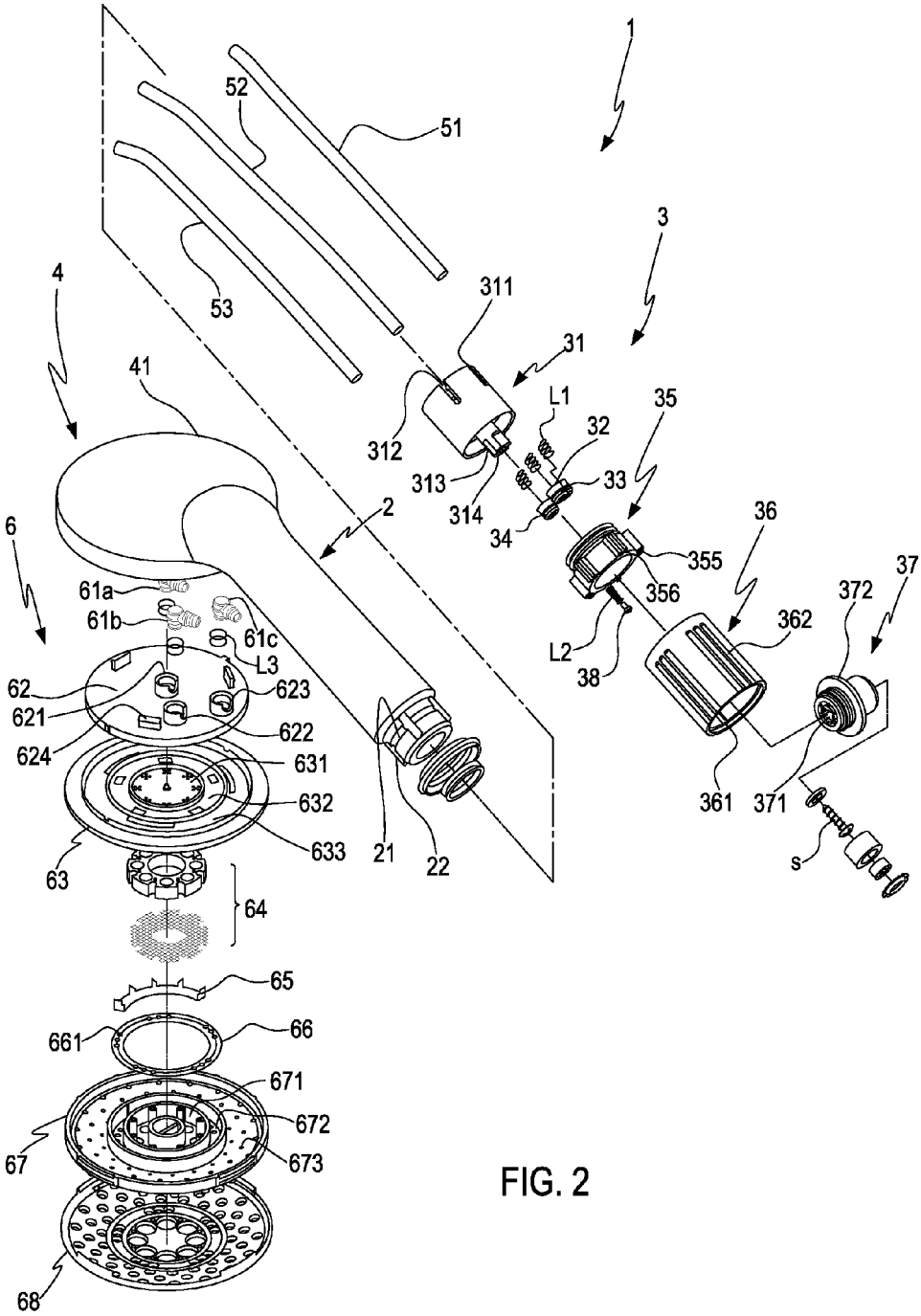
FIG. 2 is an exploded view of the structure according to the embodiment of the present invention.
Figure 3:
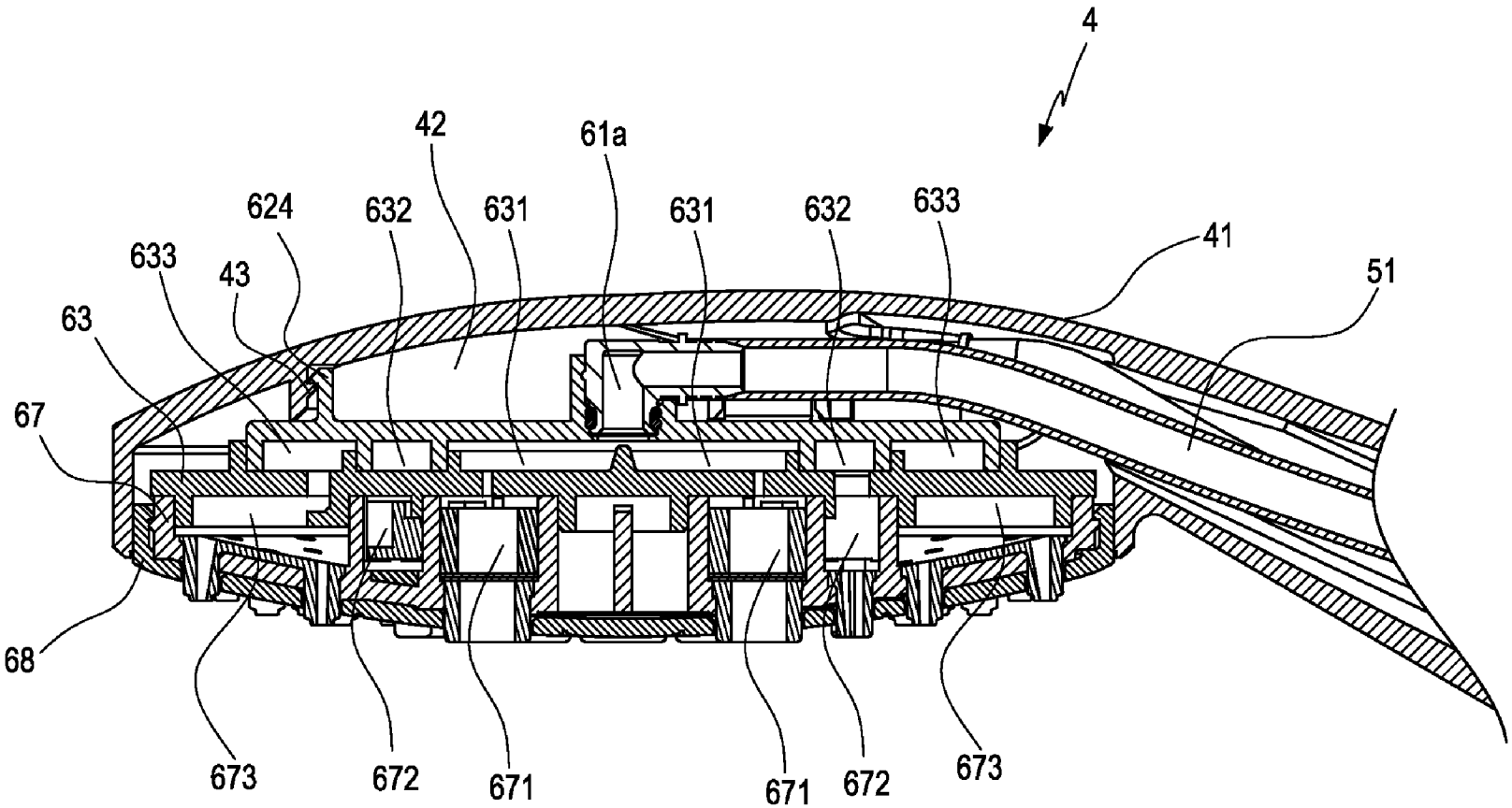
FIG. 3 is a longitudinal sectional view of a water outlet head unit according to the embodiment of the present invention.
Figure 4:
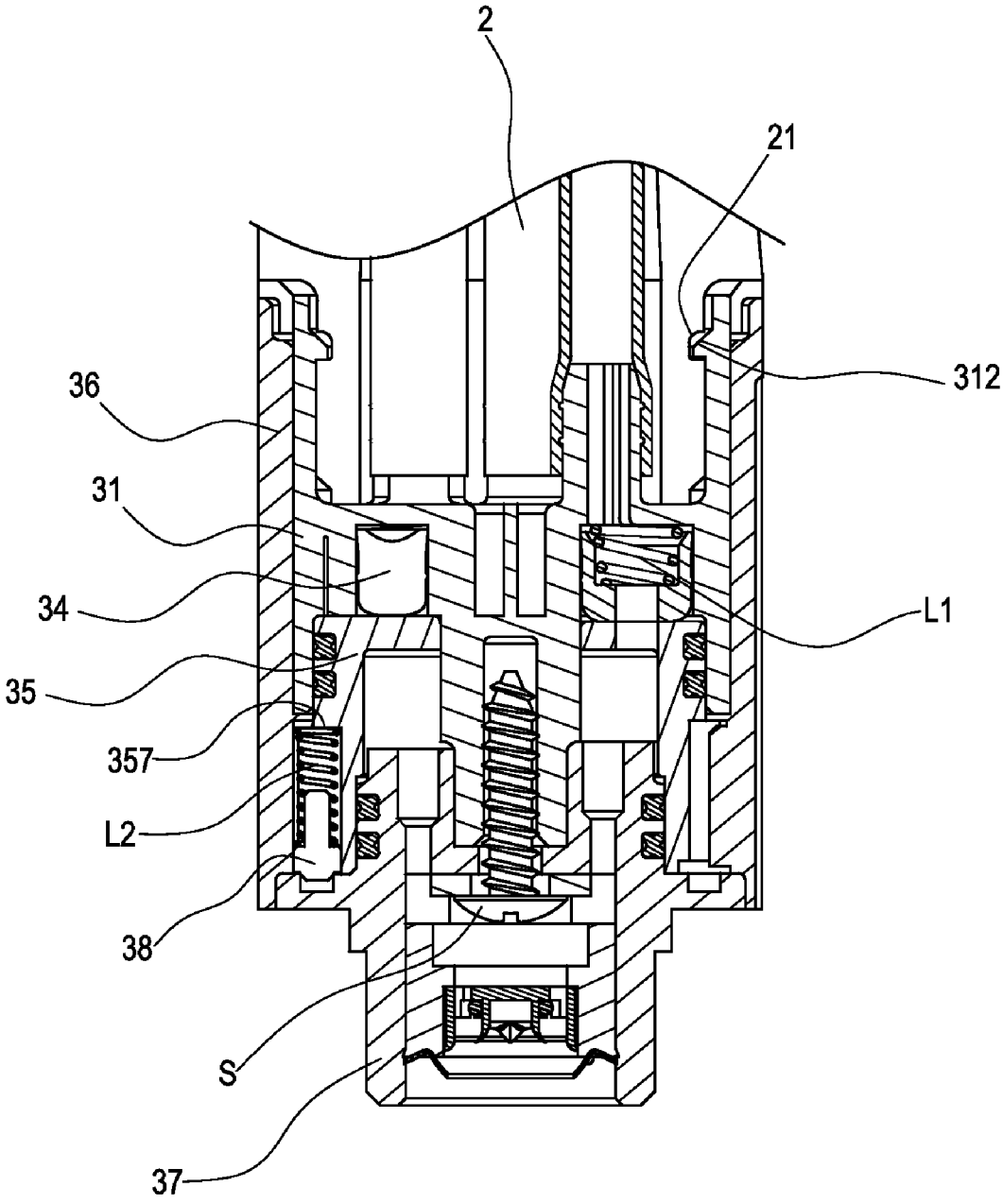
FIG. 4 is a longitudinal sectional view of a water inlet control unit according to the embodiment of the present invention.
Figure 5:
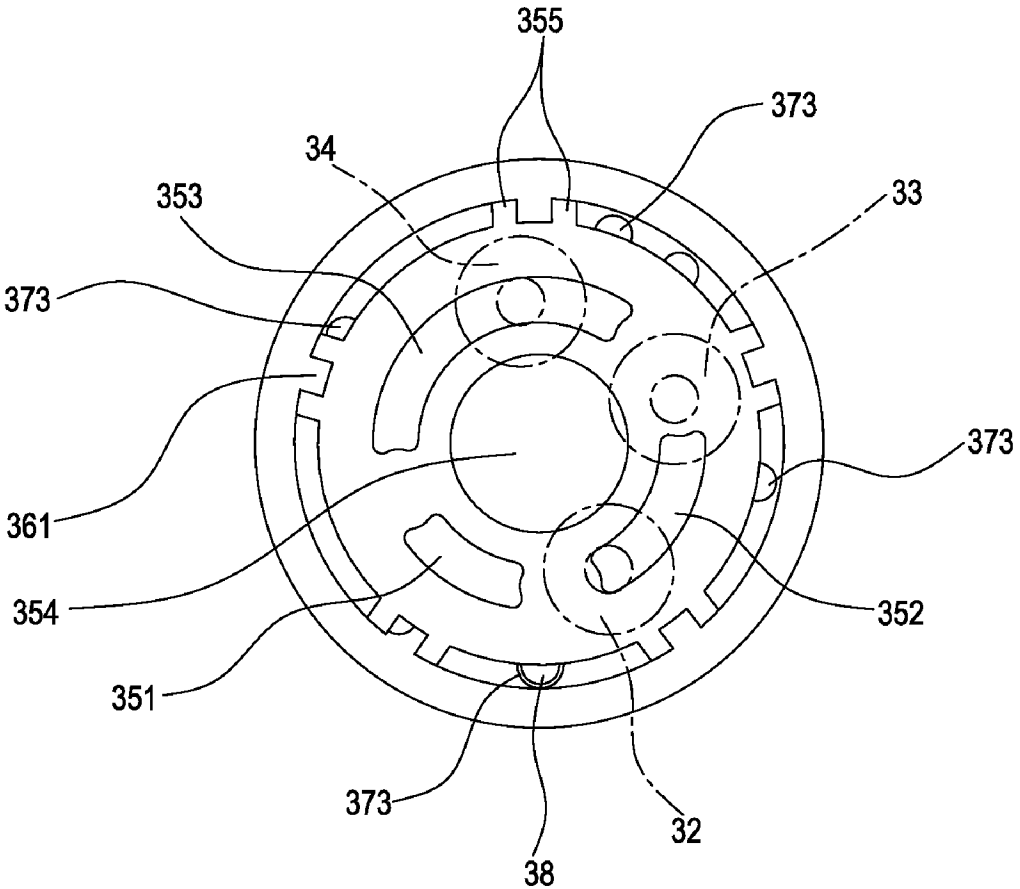
FIG. 5 is a partial top view of the water inlet control unit according to the embodiment of the present invention.

FIGS. 1 to 3 are schematic views of a structure according to a preferred embodiment of the present invention. The illustrations are mainly given below with reference to FIGS. 1 to 3, in which the structure is illustrated below in detail with reference to FIGS. 4 to 5. FIG. 1 is a schematic view of a structure according to a preferred embodiment of the present invention. FIG. 2 is an exploded view of the structure according to the embodiment of the present invention. FIG. 3 is a longitudinal sectional view of a water outlet head unit according to the embodiment of the present invention. FIG. 4 is a longitudinal sectional view of a water inlet control unit according to the embodiment of the present invention. FIG. 5 is a partial top view of the water inlet control unit according to the embodiment of the present invention.

A showerhead 1 with a rotationally adjustable handle according to a preferred embodiment of the present invention mainly includes a handle unit 2, a water inlet control unit 3, and a water outlet head unit 4.

The handle unit 2 is provided for a user to hold conveniently and has a hollow structure therein. A first end of the handle unit 2 is connected to the water outlet head unit 4 and a second end is connected to the water inlet control unit 3. The end of the handle unit 2 connected to the water inlet control unit 3 is provided with a ring groove 21 surrounding a peripheral wall thereof and provided with a plurality of rib strips 22 disposed around the peripheral wall. An axial direction of each of the rib strips 22 is the same as that of the handle unit 2 itself. In addition, the handle unit 2 has a first communicating pipe 51, a second communicating pipe 52, and a third communicating pipe 53 penetrating therethrough.

The water inlet control unit 3 sequentially includes a first fixing member 31, a first plug 32, a second plug 33, a third plug 34, a second rotary member 35, a first rotary member 36, and a second fixing member 37.

The first fixing member 31 is an approximately cylindrical-shaped structure. A peripheral wall of one end of the first fixing member 31 connected to the handle unit 2 is provided with the same number of recessed grooves 311 at positions corresponding to the rib strips 22 of the handle unit 2 and has a hook portion 312 therein. The rib strips 22 may be embedded in the recessed grooves 311 to prevent the first fixing member 31 from rotating, and the rib strips 22 are clipped in the ring groove 21 of the handle unit 2 by the hook portion 312 to fix the first fixing member 31 and prevent the first fixing member 31 from moving axially. The first fixing member 31 has a first water inlet hole, a second water inlet hole, and a third water inlet hole (not shown) at central positions thereof. The first fixing member 31 is provided with a protrusion 313 having a rectangular section axially protruded from the other end thereof, and the protrusion 313 has a screw hole 314 at a center thereof.

The second rotary member 35 is movably connected to the other end of the first fixing member 31 and provided with a first plug 32, a second plug 33, and a third plug 34 therebetween. The first plug 32, the second plug 33, and the third plug 34 are disposed corresponding to the first water inlet hole, the second water inlet hole, and the third water inlet hole (not shown), and a spring L1 is installed between each of the plugs 32, 33, and 34 and each of the water inlet holes to provide a buffer space.

Moreover, the second rotary member 35 is provided with a first water inlet groove 351, a second water inlet groove 352, and a third water inlet groove 353 of different lengths (as shown in FIG. 5) at a top portion thereof and at positions corresponding to the first plug 32, the second plug 33, and the third plug 34. Therefore, a water flow sequentially passes through each of the water inlet grooves 351, 352, and 353 of the second rotary member 35 and the corresponding plugs 32, 33, and 34, as well as the corresponding water inlet holes of the first fixing member 31. In addition, the second rotary member 35 is provided with a through-hole 354 at a center of the top portion thereof (as shown in FIG. 5) for the protrusion 313 of the first fixing member 31 to pass therethrough.

Furthermore, six sets of rib strips 355 are protruded around an outer periphery of the second rotary member 35 and spaced apart by a predetermined interval. A recessed groove 356 is formed at a center of each set of rib strips 355, and a pressing portion 357 (as shown in FIG. 4) is radially recessed between two sets of rib strips.

The first rotary member 36 is a hollow cylindrical-shaped structure and has a raised rib 361 axially disposed on an inner periphery thereof corresponding to the recessed groove 356 between each set of rib strips 355 of the second rotary member 35. The raised rib 361 is engaged with the recessed groove 356 between each set of rib strips 355, so as to fit the first rotary member 36 on the second rotary member 35. Therefore, the first rotary member 36 is rotated to drive the second rotary member 35 to rotate, and meanwhile, each of the water inlet grooves 351, 352, and 353 is controlled to move relative to the corresponding plug 32, 33, and 34, so as to further control the water flow to flow through any one or a combination of any two of the plugs.

In usage, the user may fix the handle unit 2 and then rotate the first rotary member 36, or fix the first rotary member 36 and then rotate the handle unit 2. In order to enable the user to rotate or fix the first rotary member 36 more conveniently without slipping, the first rotary member 36 is further provided with an anti-slip portion 362 on an outer periphery thereof. The anti-slip portion 362 may be a structure formed by a plurality of axial anti-slip recessed grooves, but not limited thereto.

The second fixing member 37 has a rectangular depressed portion 371 at one end thereof, so as to be engaged with the protrusion 313 of the first fixing member 31, and the rectangular depressed portion 371 is installed in the second rotary member 35 and the first rotary member 36. The first fixing member 31 and the second fixing member 37 are fixedly screwed together by a screw S, and meanwhile, the first rotary member 36 and the second rotary member 35 are clamped between the first fixing member 31 and the second fixing member 37.

An annular stopper portion 372 for stopping one end of the first rotary member 36 far away from the first fixing member 31 is protruded at a central position between both ends of the second fixing member 37. The stopper portion 372 is further provided with a plurality of stopper grooves 373 (as shown in FIG. 5) on a surface thereof facing the first fixing member 31.

In order to control the water inlet mode more stably, a spring L2 and a positioning member 38 are disposed between the inner periphery of the first rotary member 36 and the outer periphery of the second rotary member 35, i.e., in the pressing portion 357 of the second rotary member 35. One end of the spring L2 is pressed against the pressing portion 357 and the other end is pressed against the positioning member 38. One end of the positioning member 38 is pressed against the spring L2 and the other end is pressed against one of the stopper grooves 373 of the stopper portion 372 of the second fixing member 37. The first rotary member 36 is rotated to drive the second rotary member 35 to rotate, and meanwhile, the positioning member 38 is moved to be pressed against a different stopper groove 373, such that the water flow flows through different water inlet grooves 351, 352, and 353.

Therefore, through the above structure, the user controls the water inlet control unit 3 disposed at the second end of the handle unit 2 to rotate the first rotary member 36, so as to position the positioning member 38 in different stopper groove 373, thereby controlling positions of the first water inlet groove 351, the second water inlet groove 352, and the third water inlet groove 353 corresponding to the first plug 32, the second plug 33, and the third plug 34. Therefore, the water flow passes through a single plug (the first plug 32, the second plug 33, or the third plug 34) or simultaneously passes through any two plugs (the first plug 32 and the second plug 33, the first plug 32 and the third plug 34, or the second plug 33 and the third plug 34), thereby achieving a multi-stage control of the water outlet. The water flow passing through the first water inlet hole flows towards the first communicating pipe 51, the water flow passing through the second water inlet hole flows towards the second communicating pipe 52, and the water flow passing through the third water inlet hole flows towards the third communicating pipe 53.

The water outlet head unit 4 in this embodiment includes a cover cap 41 connected to the handle unit 2 and an outlet valve assembly 6. The cover cap 41 is provided with an accommodating space 42 (as shown in FIG. 3) for accommodating the outlet valve assembly 6 (as shown in FIG. 2) and three hook grooves 43.

The outlet valve assembly 6 sequentially includes a first water outlet joint 61*a*, a second water outlet joint 61*b*, a third water outlet joint 61*c*, an upper cover 62, a middle cover 63, a water aerator 64, a blade 65, a water outlet ring 66, a lower cover 67, and a face cover 68. Each of the water outlet joints 61*a*, 61*b*, and 61*c* is configured into the same L-shaped structure. One end of each of the water outlet joints 61*a*, 61*b*, and 61*c* is connected to the communicating pipe 51, 52, or 53 and the other end is disposed at the upper cover 62. The first water outlet joint 61*a* is connected to the first communicating pipe 51, the second water outlet joint 61*b* is connected to the second communicating pipe 52, and the third water outlet joint 61*c* is connected to the third communicating pipe 53.

The upper cover 62 has three hook ribs 624 protruded upward and disposed corresponding to the recessed grooves of the cover cap 41. The hook ribs 624 may be embedded in the hook grooves 43 to be fixed. The upper cover 62 is disposed with an inner water outlet hole 621, a middle water outlet hole 622, and an outer water outlet hole 623 on circumferences thereof with different radiuses. The inner water outlet hole 621 is disposed adjacent to a center of the upper cover 62, the outer water outlet hole 623 is disposed adjacent to a periphery of the upper cover 62, and the middle water outlet hole 622 is disposed between the inner water outlet hole 621 and the outer water outlet hole 623. Therefore, the first water outlet joint 61*a*, the second water outlet joint 61*b*, and the third water outlet joint 61*c* are disposed at one end of the upper cover 62, i.e., correspondingly disposed at the inner water outlet hole 621, the middle water outlet hole 622, and the outer water outlet hole 623 respectively. Preferably, a spring L3 is disposed between each of the water outlet joints 61*a*, 61*b*, and 61*c* and each of the water outlet holes 621, 622, and 623, such that a buffer space is provided when the water outlet joints 61*a*, 61*b*, and 61*c* are installed at the water outlet holes 621, 622, and 623.

The middle cover 63 has an inner ring portion 631, a middle ring portion 632, and an outer ring portion 633 disposed corresponding to the inner water outlet hole 621, the middle water outlet hole 622, and the outer water outlet hole 623 respectively. The water flow enters the inner ring portion 631 after passing through the inner water outlet hole 621. The water flow enters the middle ring portion 632 after passing through the middle water outlet hole 622. The water flow enters the outer ring portion 633 after passing through the outer water outlet hole 623.

The water aerator 64, the blade 65, and the water outlet ring 66 are disposed between the middle cover 63 and the lower cover 67. The water outlet ring 66 has a plurality of water outlet holes 661 at fixed positions spaced apart by a predetermined interval. The water aerator 64 is disposed corresponding to the position of the inner ring portion 631. The blade 65 and the water outlet ring 66 are disposed corresponding to the position of the middle ring portion 632. Therefore, a bubbly water flow is formed, after the water flow passes through the inner ring portion 631 and then passes through the water aerator 64. When the water flow passes through the middle ring portion 632, it drives the blade 65 to move in the middle ring portion 632. Through the movement of the blade 65, the water flow is blocked when the blade 65 moves to the water outlet holes 661. When the blade 65 leaves away from the water outlet holes 661, the water flow flows out via the water outlet holes 661.

The lower cover 67 has an inner ring area 671, a middle ring area 672, and an outer ring area 673 disposed corresponding to the inner ring portion 631, the middle ring portion 632, and the outer ring portion 633 of the middle cover 63 respectively. After passing through the water aerator 64, the water flow flows towards the inner ring area 671. After passing through the blade 65 and the water outlet ring 66, the water flow flows towards the middle ring area 672. In addition, the water flow flowing out via the outer water outlet hole 623 directly flows towards the outer ring area 673 of the lower cover via the outer ring portion 633 of the middle cover 63. The water outlets with different sizes are respectively distributed at the inner ring area 671, the middle ring area 672, and the outer ring area 673 of the lower cover 67 for the water flow to pass therethrough. Through bonding the lower cover 67 with the cover cap 41, the upper cover 62, the middle cover 63, the water aerator 64, the blade 65, and the water outlet ring 66 may be secured therein.

The face cover 68 may be embedded in the lower cover 67 and distributed with water outlets of different sizes corresponding to the inner ring area 671, the middle ring area 672, and the outer ring area 673 of the lower cover 67, so as to enable the water flow at different areas to flow out in a large quantity.

Through the above structure, the structures for controlling the water outlet disposed at the water outlet head unit are reduced to reduce the weight of the water outlet head unit of the showerhead. The overall structure of the water outlet head unit becomes thinner and has more flexibilities and variations for appearance design, so as to change the configurations and appearances thereof. Furthermore, when the user takes a shower and wants to adjust a water flow state, the moment of the force applied to adjust the water inlet control unit is relatively small, since the radius of the water inlet control unit is smaller than that of the water outlet head unit, and thus it is more convenient for the user to apply a force and perform the operation.

In view of the above illustrations, the features and efficacies of the hand-held showerhead structure of the present invention are listed as follows.

1 The multi-stage switching function is moved from the head of the showerhead to the end portion of the handle, such that the head obviously becomes thinner and lighter.

2. Since the head of the showerhead becomes thinner in volume, it also becomes lighter in weight, so that the showerhead gives the user a balanced feeling when being held by the user.

3. When the user switches the water flow mode while taking a shower, the moment of the applied force is reduced, such that the operation is easier and saves labor.

4. Since the head structure of the showerhead becomes thinner, the head structure has more flexibilities and variations in design, such that the configurations and appearance thereof may be varied more easily.

To sum up, the present invention meets the inventiveness requirements among similar products. Furthermore, not only the specific constructions disclosed never appeared in the products of the same kind, but also have never been published at home and abroad before the instant application. Therefore, the present application meets the requirements of a utility model patent, and thus the present application is filed for a patent according to the law.

The foregoing is merely intended to illustrate preferred embodiments of the present invention. It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A showerhead with a rotationally adjustable handle, comprising:

a handle unit, provided with a hollow structure therein and having a first communicating pipe, a second communicating pipe, and a third communicating pipe penetrating therethrough, the handle unit having a first end and a second end;

a water outlet head unit, comprising a cover cap and an outlet valve assembly, the cover cap being connected to the first end of the handle unit and provided with an accommodating space for accommodating the outlet valve assembly, and the outlet valve assembly being connected to one end of the first communicating pipe, the second communicating pipe, and the third communicating pipe; and a water inlet control unit, comprising a first fixing member, a second fixing member, a first rotary member, and a second rotary member, the first fixing member and the second fixing member being fixedly screwed to each other, and the first rotary member and the second rotary member being rotatably clamped between the first fixing member and the second fixing member, the first fixing member connected to the second end of the handle unit and the water inlet control unit rotated to control a water inlet state, so as to guide a water flow into any one or a combination of any two of the first communicating pipe, the second communicating pipe, and the third communicating pipe to flow towards the outlet valve assembly.

2. The showerhead with a rotationally adjustable handle according to claim 1, wherein the second end of the handle unit is provided with a ring groove surrounding a peripheral wall thereof and provided with a plurality of rib strips around the peripheral wall; an axial direction of each of the rib strips is the same as that of the handle unit itself; the first fixing member is an approximately cylindrical-shaped structure; a peripheral wall of one end of the first fixing member connected to the second end of the handle unit is provided with the same number of recessed grooves at positions thereon corresponding to the rib strips of the handle unit and has a hook portion therein; the rib strips of the handle unit are correspondingly embedded in the recessed grooves of the first fixing member; the first fixing member has a first water inlet hole, a second water inlet hole, and a third water inlet hole at central positions thereof; the first fixing member is provided with a protrusion having a rectangular section axially protruded from an other end thereof; and the protrusion has a screw hole at a center thereof.

3. The showerhead with a rotationally adjustable handle according to claim 2, wherein the second rotary member is movably connected to one end of the protrusion of the first fixing member and provided with a first plug, a second plug, and a third plug therebetween; the first plug, the second plug, and the third plug are disposed corresponding to the first water inlet hole, the second water inlet hole, and the third water inlet hole; a spring is installed between each of the plugs and each of the water inlet holes to provide a buffer space; the second rotary member is provided with a first water inlet groove, a second water inlet groove, and a third water inlet groove of different lengths at a top portion thereof and at positions corresponding to the first plug, the second plug, and the third plug; a water flow sequentially passes through each of the water inlet grooves of the second rotary member and the corresponding plug as well as the corresponding water inlet hole of the first fixing member; the second rotary member is provided with a through-hole at a center of the top portion thereof for the protrusion of the first fixing member to pass therethrough; a plurality of sets of rib strips is protruded around an outer periphery of the second rotary member and spaced apart by a predetermined interval; a recessed groove is formed at a center of each set of rib strips; and a pressing portion is radially recessed between two sets of rib strips.

4. The showerhead with a rotationally adjustable handle according to claim 3, wherein the first rotary member is a hollow cylindrical-shaped structure and is provided with a raised rib axially disposed on an inner periphery thereof corresponding to the recessed groove between each set of rib strips of the second rotary member; the raised rib is engaged with the recessed groove between each set of rib strips, so as to fit the first rotary member on the second rotary member; the first rotary member is rotated to drive the second rotary member to rotate, and meanwhile, each of the water inlet grooves is controlled to move with respect to the corresponding plug, so as to further control the water flow to flow through any one or a combination of any two of the plugs.

5. The showerhead with a rotationally adjustable handle according to claim 4, wherein the first rotary member is further provided with an anti-slip portion on an outer periphery thereof, and the anti-slip portion is a structure formed by a plurality of axial anti-slip recessed grooves.

6. The showerhead with a rotationally adjustable handle according to claim 4, wherein the second fixing member is provided with a rectangular depressed portion at one end thereof, so as to be engaged with the protrusion of the first fixing member; the depressed portion is installed in the first rotary member and the second rotary member and is screwed to the screw hole of the first rotary member by a screw, such that the first fixing member and the second fixing member are fixed with each other and meanwhile the first rotary member and the second rotary member are clamped between the first fixing member and the second fixing member; an annular stopper portion for stopping one end of the first rotary member far away from the first fixing member is protruded at a central position between both ends of the second fixing member; and the stopper portion is further provided with a plurality of stopper grooves on a surface thereof facing the first fixing member.

7. The showerhead with a rotationally adjustable handle according to claim 6, wherein a spring and a positioning member are disposed between the inner periphery of the first rotary member and the outer periphery of the second rotary member, i.e., in the pressing portion of the second rotary member; one end of the spring is pressed against the pressing portion and an other end thereof is pressed against the positioning member; one end of the positioning member is pressed against the spring and an other end thereof is pressed against one of the stopper grooves on the stopper portion of the second fixing member; the first rotary member is rotated to drive the second rotary member to rotate, and meanwhile, the positioning member is moved to be pressed into different stopper grooves, such that the water flow flows through different water inlet grooves.

* * * * *